US005117884A

United States Patent [19]

Diener et al.

[11] Patent Number: 5,117,884

[45] Date of Patent: Jun. 2, 1992

[54] MOLDED GOLF CLUB HEADCOVER

[75] Inventors: Lawrence R. Diener; Gale L. Halleman, both of St. Louis County, Mo.

[73] Assignee: Sinclair & Rush, Inc., St. Louis, Mo.

[21] Appl. No.: 692,557

[22] Filed: Apr. 29, 1991

Related U.S. Application Data

[63] Continuation-in-part of Ser. No. 568,699, Aug. 17, 1990.

[51] Int. Cl.[5] ..... A63B 57/00

[52] U.S. Cl. ..... 150/160; 206/315.4

[58] Field of Search ..... 150/159, 160; 206/315.2, 315.4; D21/221

[56] References Cited

U.S. PATENT DOCUMENTS

| | | | |
|---|---|---|---|
| D. 150,052 | 6/1948 | Booxbaum | D21/221 |
| D. 184,827 | 4/1959 | Mesinger | D21/221 |
| 3,051,210 | 8/1962 | Mesinger | 150/160 |
| 3,133,577 | 5/1964 | Bellevue, Sr. | 150/160 |
| 3,255,794 | 6/1966 | Morse | 150/160 |
| 3,478,799 | 11/1969 | Hoyt, Jr. | 150/160 |
| 3,603,368 | 9/1971 | Brenner | 150/160 |
| 4,971,126 | 11/1990 | Borenstein | 206/315.4 X |

FOREIGN PATENT DOCUMENTS

| | | | |
|---|---|---|---|
| 261329 | 5/1965 | Australia | 206/315.2 |
| 9008576 | 8/1990 | PCT Int'l Appl. | 150/160 |
| 1360058 | 7/1974 | United Kingdom | 206/315.2 |

*Primary Examiner*—Sue A. Weaver

*Attorney, Agent, or Firm*—Polster, Lieder, Woodruff & Lucchesi

[57] ABSTRACT

A one-piece molded flexible plastic material golf club headcover for a golf club, including a golf club head and a shank extending therefrom, is disclosed. The golf club headcover includes a club or headcover for substantially surrounding the golf club head and an integral skirt section extending from the golf club headcover section for substantially surrounding a portion of the shank immediately adjacent the golf club head. The integral skirt section is formed with a flexible and resilient circumferential wall that is configured, arranged and dimensioned to deform and then return to its original shape upon the insertion and removal of a golf club head, in order to releasably hold the golf club headcover to a golf club head when assembled thereto. The flexible and resilient circumferential wall includes a flexible and resilient restricted throat configuration that has an integral dimension smaller than the golf club head such that upon insertion into the golf club headcover, the flexible and resilient restricted throat configuration deforms and expands to allow the passage of the golf club head into the golf club headcover and then subsequently returns to its original configuration, for releasably holding the golf club headcover to the golf club head. Both the golf club headcover section and the integral skirt section have an interconnected smooth interior wall surface and a textured exterior wall surface.

11 Claims, 5 Drawing Sheets

MOLDED GOLF CLUB HEADCOVER

CROSS REFERENCE TO RELATED APPLICATIONS

This is a continuation-in-part of earlier filed design patent application Ser. No. 07/568,699 filed Aug. 17, 1990 by the same joint inventors of the present invention.

BACKGROUND OF THE INVENTION

The present invention relates to a one-piece molded flexible plastic material golf club headcover for a golf club, including a golf club head and for part of a shank extending therefrom.

It is well known to cover wood and iron golf club heads, including adjacent shank portions, with various types of covers made from various types of material to protect same against damage and deterioration. Typically, such golf club headcovers are made from the following various types of materials: knitted or woven textile materials including slip-on sox-type covers; semi-flexible material such as leather, nylon and the like; and even more flexible materials such as slip-on or hinge-type molded plastic headcovers. The slip-on molded plastic covers are generally provided with closed slotted side walls which open to permit insertion of a golf club in the headcover itself. The hinge-type molded plastic covers have two mating half sections formed in the general shape of golf club head, with an integral hinge extending therebetween, and snap fastener means for securing the two halves to one another for containing a golf club head therein. Typically, both the slip-on and hinge-type molded plastic covers are bound by injection molding techniques and are primarily used for formed head golf club headcovers.

All of the foregoing have been used quite effectively in protecting both wood head and iron head golf clubs from damage and deterioration, and yet, they all have many of the same inherent disadvantages. One of the problems is that the prior art golf club headcovers are not built to last. Particularly in the case of knitted or woven textile materials and semi-flexible materials, they have a tendency to tear or come apart or crack during heavy use. While the slip-on and hinge-type molded plastic cover discussed above are more durable and long lasting, they have been used only on iron head gold clubs. Thus, there has been long felt need for a durable and long lasting club headcover which is capable for use with both wood headed and iron headed golf clubs. Another problem with prior art golf club headcovers is that they do not protect the investment made in the golfer's valuable clubs. In most instances, prior art headcovers do not cushion and guard the club head and immediate shaft areas against nicks and scratches during shipment or play. Most of the materials used in the prior art have also not provided waterproof protection for expensive wood headed golf clubs. In the case of the slip-on or hinge-type molded plastic headcovers, they have been used primarily for iron headed golf clubs, and even these particular headcovers do not sufficiently protect the shaft areas immediately adjacent to the golf club head against damage, and further do not provide any waterproof protection. Many of prior art golf club headcovers are also difficult to use, in that they do not go on easy and stay on the club. Over extended use, they can become worn, making it easy for them to slip-off or become disassociated relative to a golf club head.

The above or some of the inherent limitations in existing prior art headcovers which are overcome by the unique features of the present invention. In addition, there are many other new and distinguishing features of the present invention which will become apparent from the discussion that is to follow.

SUMMARY OF THE INVENTION

Among the several objects and advantages of the present invention include:

The provision of a new and improved golf club headcover which is made from a one-piece molded flexible plastic material including a golf club headcover section and an integral skirt section extending therefrom;

The provision of the aforementioned golf club headcover which includes a flexible and resilient circumferential wall in the integral skirt section that is configured, arranged and dimensioned to deform and then return to its original shape upon the insertion and removal of the golf club head, in order to releasably hold the golf club headcover to a golf club head when assembled thereto;

The provision of the aforementioned golf club headcover wherein the flexible and resilient circumferential wall of the integral skirt section includes a flexible and resilient restricted throat configuration which deforms and then returns to its original configuration, for releasably holding the golf club headcover to the golf club head;

The provision of the aforementioned golf club headcover which includes a smooth interior wall surface and a textured exterior wall surface for both the golf club headcover section and the integral skirt section of the golf club headcover;

The provision of the aforementioned golf club headcover which is built to last in that it is strong and durable during heavy use; provides protection to valuable clubs from damage during shipment or play; provides extra protection around the club head as well as adjacent shaft)areas to guard against nicks and scratches; provides complete waterproof protection for expensive wood and iron golf clubs; and is easy to keep clean, thus preventing deterioration of the golf club headcover;

The provision of the aforementioned golf club headcover provides complete club coverage for both wood headed and iron headed golf clubs; may be suitably printed to facilitate the selection of the golf club desired by the golfer; provides an attachment between adjacent headcovers to prevent cover loss, while keeping the clubs in order, and can be made in a number of different colors to enable a golfer to choose a desired favorite color.

Briefly stated, the present invention relates to a one-piece molded flexible plastic material golf club headcover for a golf club including a golf club head and a shank extending therefrom. The golf club headcover section is constructed to substantially surround the golf club head. An integral skirt section is provided that extends from the golf club headcover section and substantially surrounds a portion of the shank immediately adjacent the golf club head. The integral skirt section is provided with a flexible and resilient circumferential wall that is configured, arranged and dimensioned to deform and then return to its original shape upon the insertion and removal of a golf club head, in order to releasably hold the golf club headcover to a golf club head when assembled thereto.

The golf club headcover section can be molded in either the shape of a wood headed or iron headed golf club. In either instance, the integral skirt section is provided with a flexible and resilient restricted throat configuration that has an internal dimension smaller than the golf club head such that upon insertion of the golf club head into the golf club headcover, the flexible and resilient restricted throat configuration deforms and expands to allow the passage of the golf club head into the golf club headcover and then returns to its original configuration, for releasably holding the golf club headcover to the golf club head.

Where the golf club head is a wood headed club, at least one peripheral portion of the integral skirt section is formed to extend inwardly relative to other peripheral portions in order to provide the flexible and resilient restricted throat configuration. Preferably, there are spaced peripheral portions of the integral skirt which extend inwardly relative to other peripheral portions in order to provide the flexible and resilient restricted throat configuration. In the disclosed embodiment, the integral skirt section includes four peripheral wall areas, with three of the peripheral wall areas extending inwardly to provide the flexible and resilient restricted throat configuration.

Where an iron headed golf club is used, the iron headed golf club headcover has the integral skirt section thereof provided with a generally collapsed oval cross-sectional configuration to provide the flexible and resilient throat configuration. In such case, both a major and minor axes of the generally collapsed oval cross-sectional configuration of the integral skirt is preferably smaller than the length and width of the iron club head of the iron headed golf club. One end of the generally collapsed oval cross-sectional configuration in the integral skirt section also preferably has a shape complementary to the shank immediately adjacent the iron club head for conforming to the shape thereof.

In order to allow the golf club headcover to be easily pulled over a golf club head, both the golf club headcover section and the integral skirt section have an interconnected smooth interior wall surface to facilitate sliding slip-on assembly and disassembly of the golf club headcover to a golf club head. Also, the golf club headcover section and integral skirt section have an interconnected textured exterior wall surface to facilitate gripping in assembling or disassembling the golf club headcover relative to a golf club head.

The molded flexible plastic material from which the golf club headcover is made has a greater cross sectional thickness in the vicinity of the golf club head than the golf club head shank for added protection thereto. The molded flexible plastic material is preferably a polyvinylchloride.

In order to secure a series of golf club headcovers to one another, both the wood headed and iron headed golf club headcovers include attachment means such that a convenient lace can secure adjacent golf club headcovers to one another, preventing headcover loss and also helping to keep the clubs in order.

These and other objects of the present invention will become apparent from the more detailed and specific description of the present invention set forth below.

BRIEF DESCRIPTION OF THE DRAWINGS

In the drawings.

Corresponding reference numerals will be used throughout the several figures of the drawings.

DESCRIPTION OF THE PREFERRED EMBODIMENT

The following detailed description illustrates the invention by way of example and not by way of limitation. This description will clearly enable one skilled in the art to make and use the invention. and describes several embodiments, adaptions, variations, alternatives and uses of the invention, including what I presently believe is the best mode of carrying out the invention.

Figure 1:
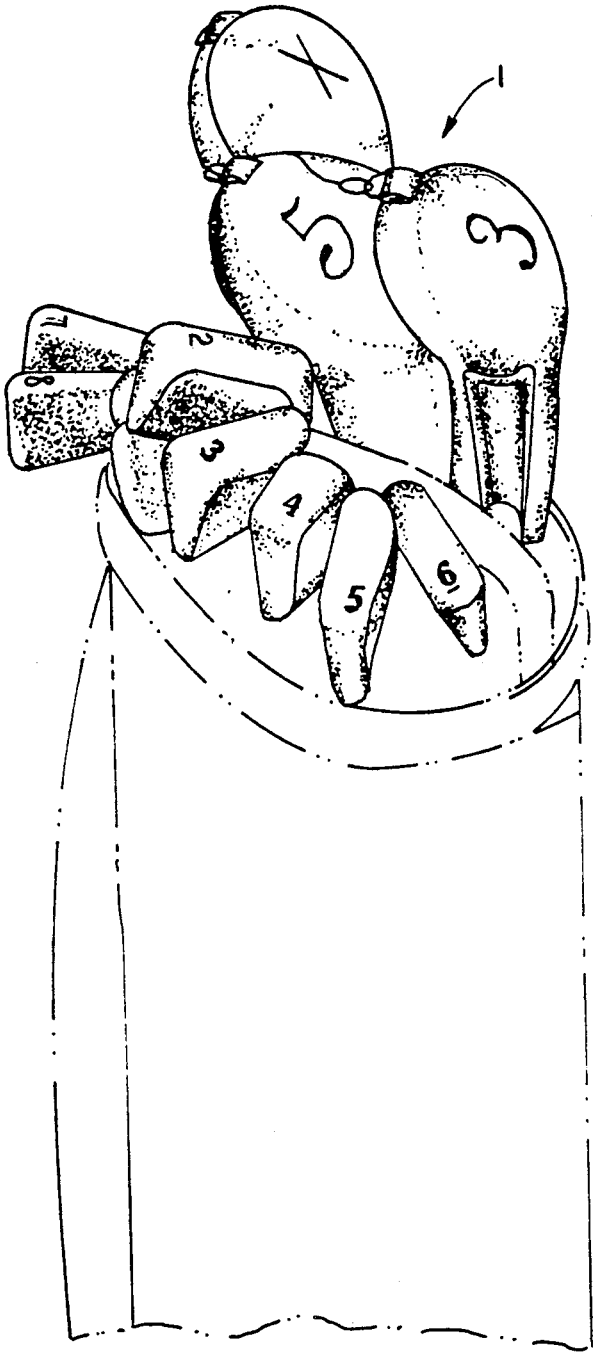
FIG. 1 is a fragmentary perspective view showing a golf club bag, in phantom lines, containing a series of wood head and iron head golf clubs, each having a one-piece molded flexible plastic material golf club headcover mounted over an associated wood club head or iron club head, with each such golf club headcover being constructed in accordance with the teachings of the present invention.

The present invention relates to a golf club headcover for both woods and irons although the construction and operation the gold club headcover for woods is different from the golf club headcover for irons, as will be disclosed in detail. In FIG. 1 of the drawings, the golf bag shown in phantom lines contains both golf club headcovers for woods and golf club headcovers for irons separately assembled over wood golf clubs and iron golf clubs, respectively. Specific details related to the golf club headcover for woods are shown in FIGS. 2-10 and 21-22 of the drawings, while the specific construction of the golf club headcover for irons is shown in FIGS. 11-20 and 23-24 of the drawings.

Figure 2:
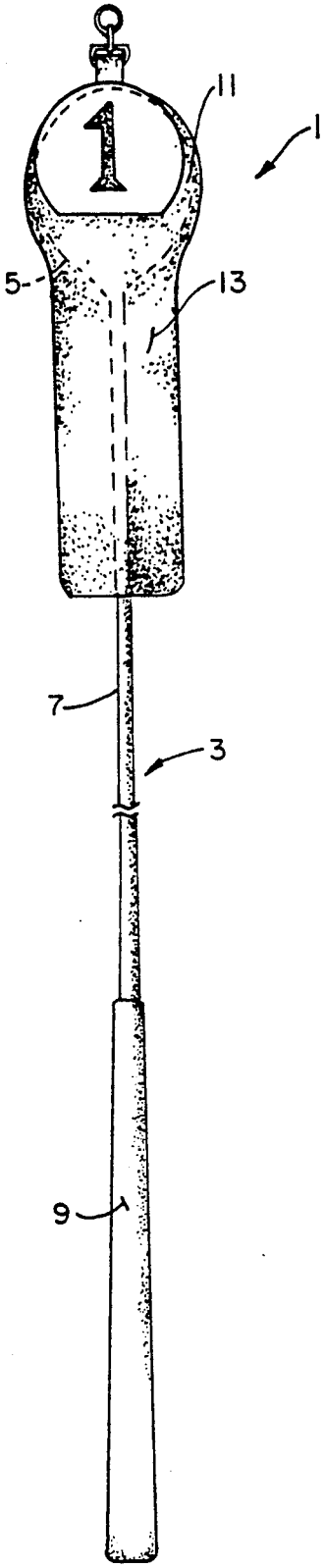
FIG. 2 is a front elevational view of a driver or number 1 wood head club with an associated golf club headcover of the present invention assembled thereto.
Figure 5:
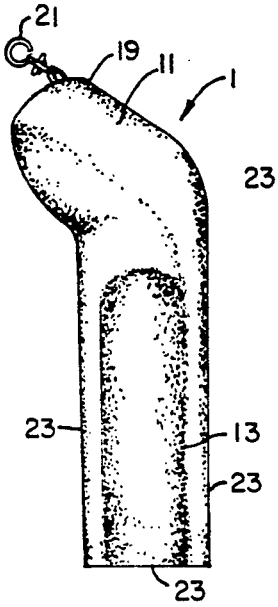
FIG. 5 is a side elevational view of the golf club headcover for woods as illustrated in FIGS. 2–4.
Figure 6:
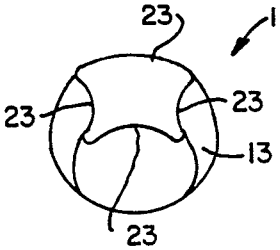
FIG. 6 is a bottom plan view of the golf club headcover for woods as illustrated in FIGS. 2–5.
Figure 7:
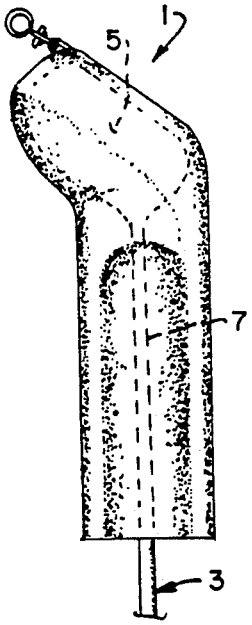
FIG. 7 is a side elevational view of the golf club headcover for woods with a wood club head and associate shank shown in phantom lines mounted therein.

Referring first to the gold club headcover for woods 1 illustrated in FIGS. 2-10 and 21-22 of the drawings, it will be seen that the club headcover for woods 1 is designed to be used on a wood golf club 3 including a wood golf club head 5 and a shank 7 extending therefrom, including a handle 9 for gripping by the golfer, as is well known. The golf club headcover for woods 1 includes a golf club or headcover section 11 substantially surrounding the wood golf club head 5, as shown in FIGS. 2 and 7 of the drawings, and an integral skirt section 13 that extends from the gold club headcover section 11 and substantially surrounds a portion of the shank 7 immediately adjacent the golf club head 5.

The golf club headcover for woods 1, shown in FIGS. 2-10 and 21-22 of the drawings, is preferably formed by dip molding techniques. Specifically, a mold mandrel (not shown), conforming to the inside shape and configuration of the golf club headcover for woods 1, is dipped into a vat of plastisol, such as polyvinylchloride or the like, which is also a coarse grain material. Because the mold mandrel (not shown) is preferably sufficiently heated, the interior wall surface 15 interconnecting both the golf club headcover section 11 and the integral skirt section 13 is formed smooth, whereas the exterior surface 17, also interconnecting the golf club headcover section 11 and the integral skirt section 13, is textured, due to the coarse grain material remaining out of contact with the mold mandrel (not shown). As a result, a wood headed golf club 3 will easily slide along the smooth interior wall surface 15 of the golf club headcover for woods 1, during assembly and disassembly thereof, whereas the textured exterior wall surface 17 enables the golfer to more easily grip the golf club headcover for woods 1, during that same process. The advantage of these features will become more apparent in discussing how the golf club headcover for woods 1 is assembled and disassembled relative to a golf wood club 3.

Figure 3:
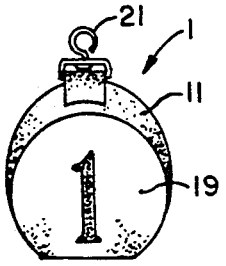
FIG. 3 is a top plan view of a golf club headcover for woods as shown in FIG. 1.
Figure 4:
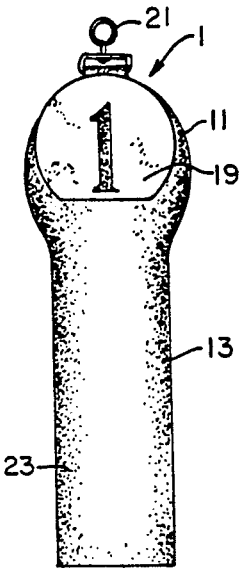
FIG. 4 is a front elevational view of the golf club headcover for woods as shown in FIGS. 1–2.
Figure 8:
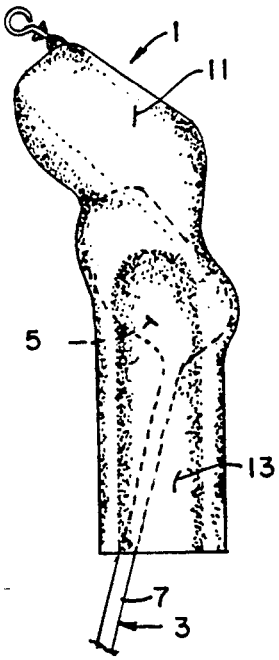
FIG. 8 is a side elevational view illustrating the manner in which the wood head club deforms and expands the integral skirt section of the golf club headcover during insertion and removal therefrom.
Figure 9:
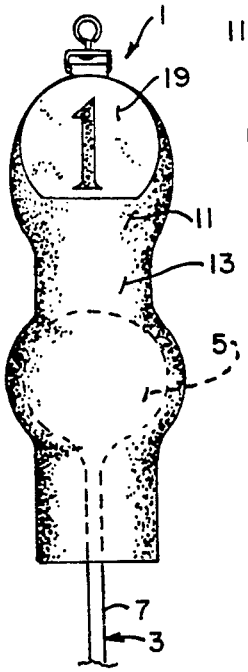
FIG. 9 is a front elevational view for illustrating the wood club head in phantom lines in the same position as seen in FIG. 8, and further illustrating the manner in which associated wall portions of the integral skirt section are deformed during insertion and removal of the wood club head relative to the golf club headcover for woods.

In FIGS. 3-6 of the drawings, the construction and shape of the golf club headcover for woods is disclosed, while FIGS. 7-10 illustrate the manner in which the wood golf club 3 is assembled and disassembled relative to the golf club headcover for woods 1. As best seen in FIGS. 3-5, the golf club headcover section 11, which substantially surrounds the golf club head 5, is generally conformed or shaped to the wood club head 5, as is illustrated. A flat, but angularly offset surface 19 is formed in the golf club headcover section 11, generally parallel with the bottom surface (not shown) of the golf club head, in order to enable various numerals to be stamped or imprinted thereon, for identifying a particular wood golf club. As illustrated in FIGS. 3-4 and 9 of the drawings, the flat, but angularly offset surface 19 is stamped or imprinted with the numeral 1, representing the driver or number 1 wood of the golf club set.

Attached to curved upper rounded surface of the golf club headcover section 11 is an attachment ring 21, which is secured to the golf club headcover section 11 by any suitable means, for securing adjacent golf headcovers for woods in assembled relationship to one another, to prevent cover loss and to also keep the golf clubs in order in the golf bag.

Figure 22:
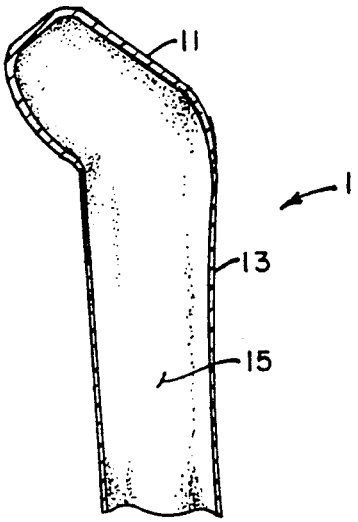
FIG. 22 is a sectional view of the golf club headcover for woods as shown in FIG. 21 and illustrating the smooth interior wall surface interconnecting the golf club headcover and integral skirt sections thereof.

In order to protect the club head against damage during shipment or play, the golf club headcover section 11 is shown in FIG. 22 as having a greater cross sectional thickness than the integral skirt section 13 extending therefrom, in order to provide extra protection for the club head. In this connection, it will be also noted that the integral skirt section 13 is also constructed to extend well down the shaft 7 adjacent the club head 5, in order to also guard against nicks and scratches.

Referring now to the construction of the integral skirt section 13, it will be seen in FIGS. 4-6 of the drawings that the integral skirt section 13 comprises a flexible and resilient circumferential wall, including four peripheral wall areas 23. Preferably, three of these peripheral wall areas 23 are inwardly deformed to provide a flexible and resilient restricted throat configuration that has an internal dimension smaller than the wood head of the wood headed golf club.

Figure 10:
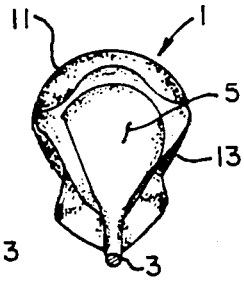
FIG. 10 is a bottom plan view of either the FIGS. 8 or 9 illustration and showing the deformation of the flexible and resilient circumferential wall of the integral skirt section during the insertion and removal of the wood head club.

In this connection, reference is now made to FIGS. 7-10 of the drawings which illustrate how the flexible and resilient restricted throat configuration of the integral skirt section 13 deforms and expands relative to the wood headed golf club 3. In FIG. 7 of the drawings, the golf club 3, including the wood head 5, are shown in phantom lines in completely assembled position relative to the club headcover 1. In FIGS. 8-10, the wood head 5 is shown in dotted lines as deforming and expanding the flexible and resilient restricted throat configuration of the integral skirt section 13, at approximately the same location in side elevational, front elevational and bottom plan views of the golf club headcover for woods 1.

More specifically, as the club head 5 is inserted or removed relative to the integral skirt section 13, the flexible and resilient restricted throat configuration, formed by the peripheral wall portions 23 thereof, deforms and expands, upon the insertion and removal of the club head 5, to allow the passage of the wood club head 5 into the integral skirt section 13, and then into the golf club headcover section 11, allowing the integral skirt section 13, including the flexible and resilient restricted throat configuration thereof, to return to its original configuration, for releasably holding the golf club headcover 1 to the wood club head 5 and the golf club 3, as will be apparent. In each of FIG. 8-10, the manner in which the integral skirt section 13 is deformed and expanded, in its flexible and resilient restricted throat configuration, is illustrated. Thus, the golf club headcover for woods 1 includes a snap-on feature, through the use of the flexible and resilient restricted throat configuration of the integral skirt section 13.

Unlike other prior art designs, the golf club headcover for woods 1 provides complete waterproof protection for expensive wood clubs, as well, in view of the one-piece molded flexible plastic material construction. Additionally, the strength, flexibility and durability of the one-piece molded flexible plastic material golf club headcover for woods 1 prevents cracking, tearing or "coming apart" even during heavy use. Clean-up is also easy, requiring brushing with warm soapy water only, and the golf club headcovers will then look like new.

Figure 17:
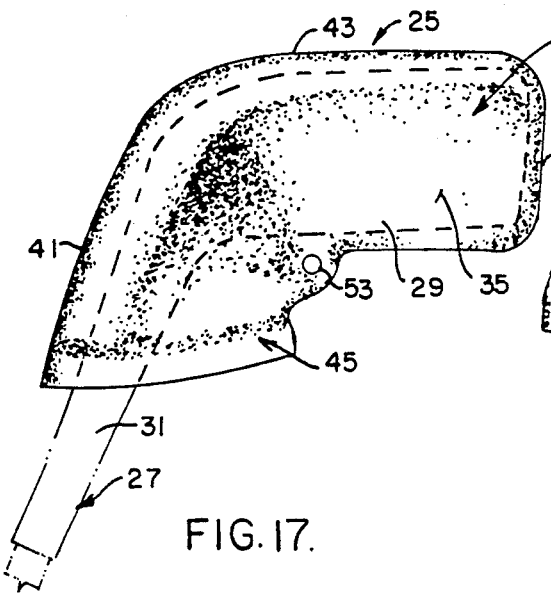
FIG. 17 is a front elevational view of the golf club headcover for irons with an iron head and its associated shank shown in phantom lines and being mounted within the golf club headcover for irons.
Figure 18:
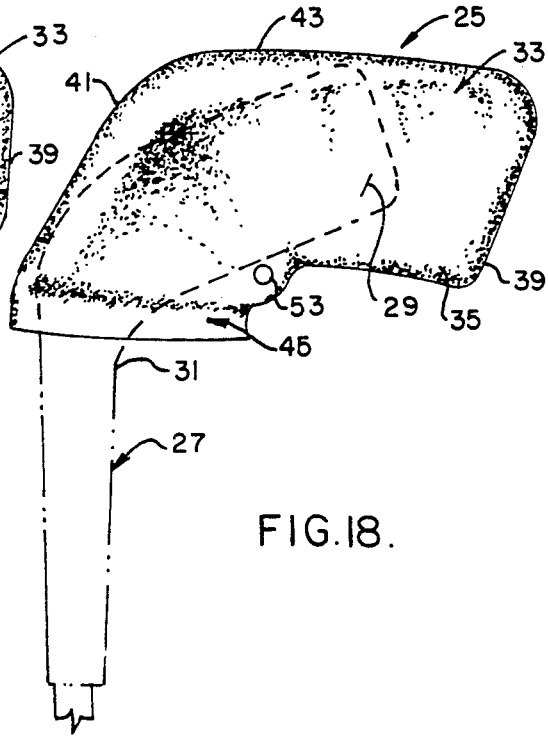
FIG. 18 is a front elevational view of the golf club headcover for irons, and with the iron club head and its associated shank also being shown in phantom lines as it is partially removed from the golf club headcover for irons.
Figure 19:
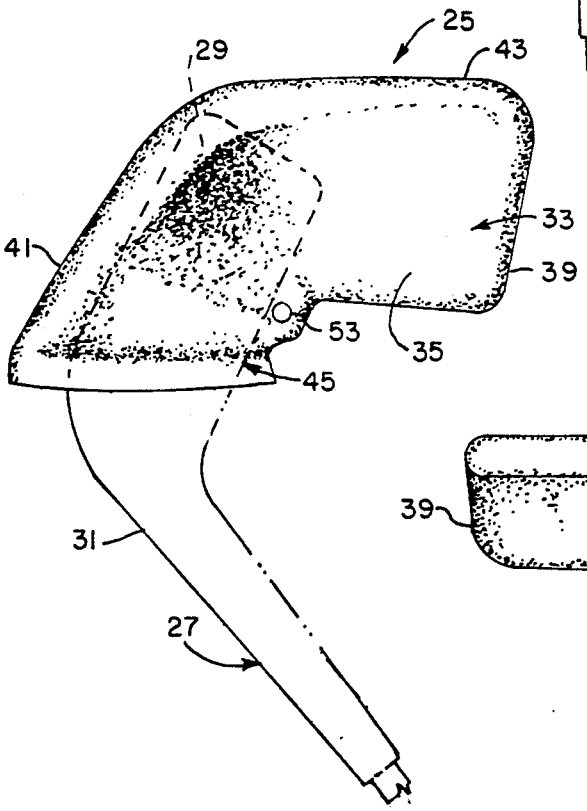
FIG. 19 is a further front elevational view of the gold club headcover for irons with the phantom representation of the iron club head and associated shank in a different position, at an even more tilted angle relative to the golf club headcover for irons.

Other that the specific construction and shape of the golf club headcovers for irons 25 illustrated in FIGS. 11-20 and 23-24 of the drawings, the same advantages and features described above are also inherent in the golf club headcovers for irons 27, now to be described As best seen in FIGS. 11 and 15-19, the golf club headcover for irons 25 is constructed for use with the iron golf club 27 including the iron head 29 and associated shank 31, as best shown in FIGS. 17-19 of the drawings. The golf club headcover for irons 25 includes a golf club headcover section 3 that is formed in shape to the iron head 29 of the iron golf club 27, in order to substantially surround the golf club iron head 29. In this connection, while iron club head 29 does not have the same thickness of the wood head 5, it is well known that iron club heads extend at various angles relative to the shaft 31, and thus, the golf club headcover section 33 is an angular offset shape corresponding to the angular offset of a particular iron club head, as shown for example in FIGS. 12 and 20. For this purpose, the golf club headcover section 33 includes front and rear walls 35, 37, corresponding to the front and rear faces of an iron club head (not shown), as well as front and rear end walls 39, 41, also corresponding to the front and rear end surfaces of the iron club head (not shown).

Figure 11:
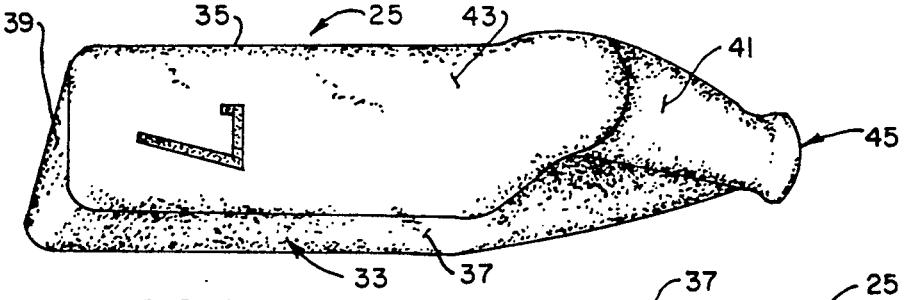
FIG. 11 is a top plan view of a golf club headcover for irons which is constructed in accordance with the teachings of the present invention.

The golf club headcover section 33 further includes a top wall 43 interconnecting front and rear walls 35, 37 and front and rear end walls 39, 41, as best seen in FIG. 11, allowing a number to be imprinted or stamped thereon, for appropriate identification of the club with which the golf club headcover for irons 25 is to be used. In this case, the numeral 7 has been stamped on the golf club headcover for irons 25, to indicate that a number 7 iron will be used with this particular headcover.

Figure 12:
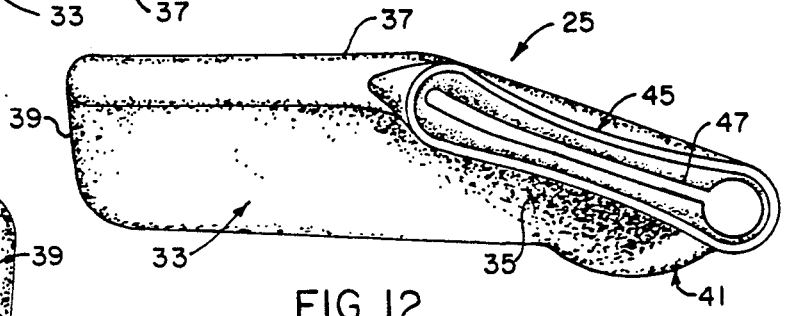
FIG. 12 is a bottom plan view of the golf club headcover for irons shown in FIG. 11.
Figure 13:
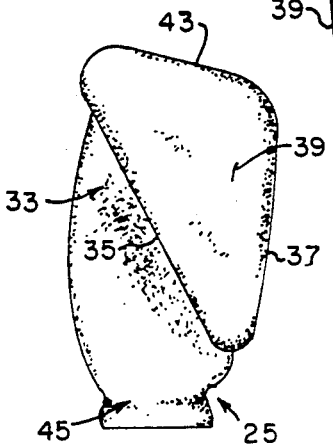
FIG. 13 is a one end elevational view of the golf club headcover for irons as shown in FIGS. 11–12.
Figure 14:
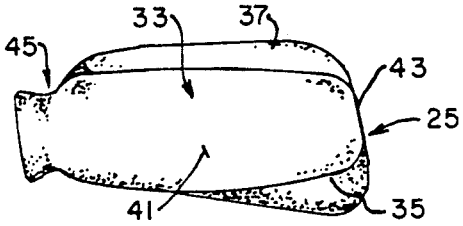
FIG. 14 is the other end view of the golf club headcover for irons shown in FIGS. 11–12.
Figure 15:
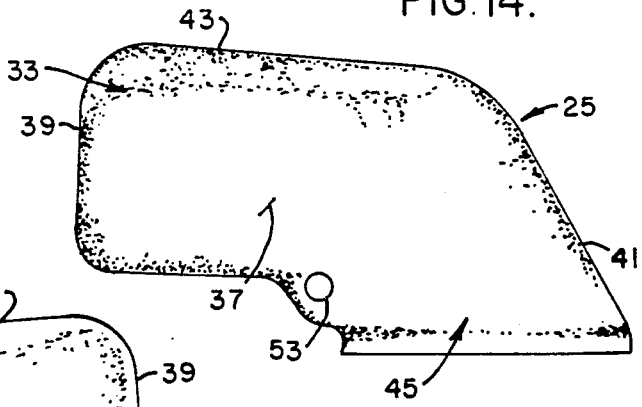
FIG. 15 is a rear elevational view of the golf club headcover for irons shown in FIGS. 11–14.
Figure 16:
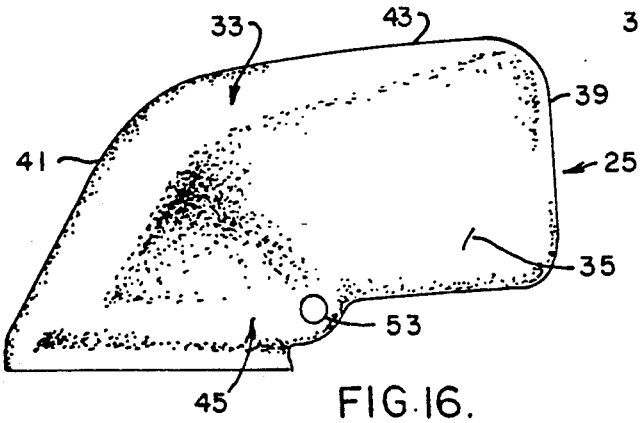
FIG. 16 is a front elevational view of the golf club headcover for irons as shown in FIGS. 11–15.
Figure 20:
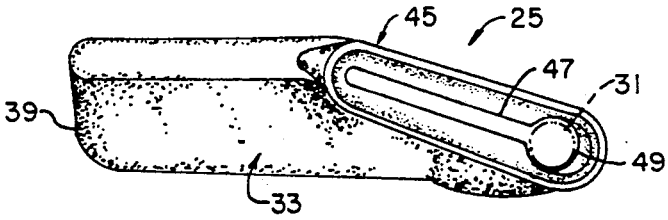
FIG. 20 is a bottom plan view of the golf club headcover for irons showing the shank of the golf club head positioned in a complementary opening formed in the integral skirt section of the golf club headcover for irons.
Figure 21:
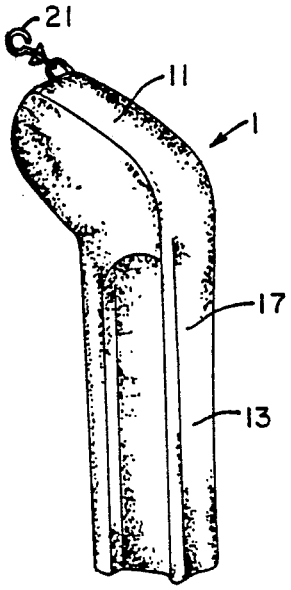
FIG. 21 is a perspective elevational view of the golf club headcover for woods and illustrating the textured exterior wall surface for the golf club headcover and integral skirt sections thereof.

In addition to the golf club headcover section 33, for substantially surrounding the iron golf club head 29, the golf club headcover for irons 25 includes an integral skirt section 45 which also has a flexible and resilient restricted throat configuration requiring deformation and expansion thereof in order to allow the passage of an iron head into and out of the golf club headcover for irons 25. In this connection, and as best seen in FIGS. 12 and 20, the integral skirt section 45 has a generally collapsed oval cross-sectional configuration 47 by the flexible and resilient restricted throat configuration. It will be further noted that the major and minor axes of the generally collapsed oval cross-sectional configuration 47 of the integral skirt section 45 is smaller than the length and width of the iron club head 29, for purposes shortly to be described. Additionally, one end of the generally collapsed oval cross-sectional configuration 47 of the integral skirt section 45 has a shape generally complementary to the shank 31 immediately adjacent the iron club head 29 for conforming to the shape thereof, as best seen in FIG. 20 of the drawings.

Referring now to FIGS. 17-20 of the drawings, the iron head 29 is shown as positioned within the golf club headcover section 33 of the golf club headcover for irons 25. In such position, the golf club headcover section 33 substantially surrounds the golf club iron head 29, as illustrated. As the iron golf club 27 is removed relative to the golf club headcover for irons 25, it will be noted that shank 31 is tilted, as best seen in FIGS. 18-19, in order to allow the iron head 9 to readily pass through the generally collapsed oval cross-sectional configuration 47 of the integral skirt section 45. In so doing; however, the iron head 29, due to its angular offset shape, will cause the generally collapsed oval cross-sectional configuration 47 to deform and expand, and in order to allow the iron head to pass therethrough. Thereafter, the generally collapsed oval cross-sectional configuration 47 of the integral skirt section 45 returns to its original configuration. It will be apparent that by reversing the aforementioned steps, the iron head 29 can be positioned from the FIG. 19 to the FIG. 17 location relative to the golf club cover section 33, where it is releasably held in position, due to the flexible and resilient restricted throat configuration of the integral skirt section 45. Thus, the golf club headcover for irons 25, as illustrated in FIGS. 11-20 and 23-24, functions in the same manner as the golf club headcover for woods 1, except that construction and shape thereof, by necessity, is entirely different due to the different construction and shape of the wood headed and iron headed golf clubs.

Figure 23:
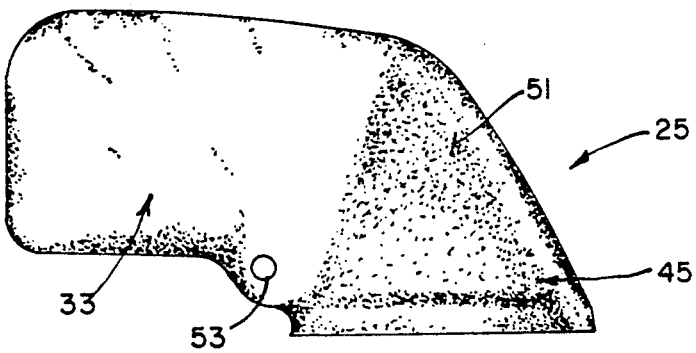
FIG. 23 is a rear elevational view of a golf club headcover for irons with a textured exterior wall surface on both the golf club headcover and integral skirt sections.
Figure 24:
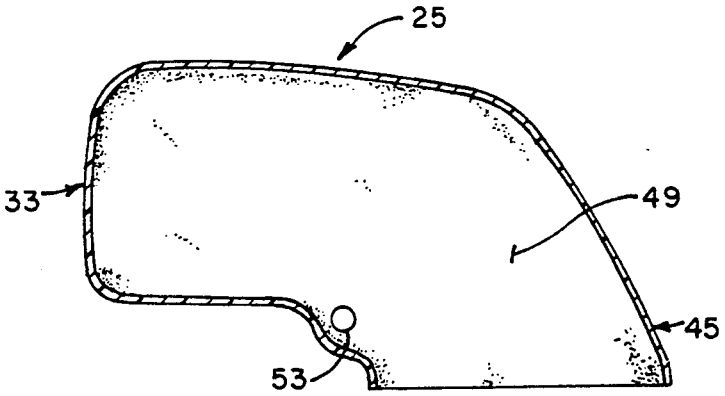
FIG. 24 is a sectional view of the golf club headcover for irons shown in FIG. 23 and illustrating the smooth interior wall surface for both the golf club headcover and integral skirt sections thereof.

The golf club headcover for irons 25 also has a smooth interior wall surface 49, as shown in FIG. 24 and a textured exterior wall surface 51, as shown in FIG. 23, for both the golf club headcover and integral skirt sections.

An aperture or hole 53 is formed in the opposed front and rear walls 35, 37 of the golf club headcover section 33 for receiving a convenient lace to retain a series of golf club headcovers for irons in assembled and numbered position on the lace, as desired.

From the foregoing, it will now be appreciated that the one-piece molded flexible plastic material golf club headcover of the present invention provides numerous features and advantages not shown by the prior art, while achieving the several objects and features of the present invention with unexpected advantageous results.

As various changes could be made in the above constructions without departing from the scope of the invention, it is intended that all matter contained in the above description or shown in the accompanying drawings shall be interpreted as illustrative and not in a limiting sense.

We claim:

1. A one-piece molded flexible plastic material golf club headcover for a golf club including a golf club head and a shank extending therefrom, comprising:

a golf club headcover section for substantially surrounding the golf club head;

an internal skirt section extending from said golf club headcover section and substantially surrounding a portion of the shank immediately adjacent the golf club head, said integral skirt section having a flexible and resilient circumferential wall which is configured, arranged and dimensioned to deform and then return to its original shape upon the insertion and removal of a golf club head, in order to releasably hold the golf club headcover to a golf club head when assembled thereto;

both said golf club headcover section and said integral skirt section each having throughout the entire peripheral extend thereof an interconnected smooth interior wall surface and a coarse grain textured exterior wall surface which are jointly molded on opposite interior and exterior surfaces of the golf club headcover section and integral skirt section, said smooth interior wall surface enabling a golf club head to be slidably inserted and removed from the golf club headcover section and integral skirt section while said textured exterior wall surface facilitates gripping of the golf club headcover and interior skirt section by a user; and said golf club headcover section having a greater cross sectional thickness throughout substantially the entire extent thereof than said integral skirt section to provide added protection for a golf club head when associated with said golf club headcover section.

2. The golf club headcover as defined in claim 1 wherein the golf club headcover section is molded in the shape of a wood headed golf club, and the integral skirt section extending therefrom includes a flexible and resilient restricted throat configuration that has an internal dimension smaller than the wood head of the wood headed golf club such that upon insertion of the wood head, the flexible and resilient restricted throat configuration deforms and expands to allow the passage of the wood head into the golf club headcover and then returns to its original configuration, for releasably holding the golf club headcover to the wood head of the wood headed golf club.

3. The golf club headcover as defined in claim 2 wherein at least one peripheral portion of said integral skirt section is formed to extend inwardly relative to other peripheral portions in order to provide said flexible and resilient restricted throat configuration.

4. The golf club headcover as defined in claim 3 wherein there are spaced peripheral portions of said integral skirt section which extend inwardly relative to other peripheral portions to provide said flexible and resilient restricted throat configuration.

5. The golf club headcover as defined in claim 4 wherein said integral skirt section includes four peripheral wall areas, and three of said peripheral wall areas extend inwardly to provide said flexible and resilient restricted throat configuration.

6. The golf club headcover as defined in claim 5 wherein the golf club headcover section includes attachment means for securing a series of golf club headcovers to one another.

7. The golf club headcover as defined in claim 1 wherein the golf club headcover section is molded in the shape of an iron headed golf club, and the integral skirt section extending therefrom includes a flexible and resilient restricted throat configuration that has an internal dimension smaller than the iron head of the iron headed golf club such that upon insertion of the iron head, the flexible and resilient restricted throat configuration deforms and expands to allow the passage of the iron head into the golf club headcover and then returns to its original configuration, for releasably holding the golf club headcover to the iron head of the iron headed golf club.

8. The golf club headcover as defined in claim 7 wherein the integral skirt section has a generally collapsed oval cross-sectional configuration to provide said flexible and resilient restricted throat configuration.

9. The golf club headcover as defined in claim 8 wherein both the major and minor axes of the generally collapsed oval cross-sectional configuration of said integral skirt section are smaller than the length and width of the iron club head of the iron headed golf club.

10. The golf club headcover as defined in claim 9 wherein one end of said generally collapsed oval cross-sectional configuration in said integral skirt section has a shape complementary to the shank immediately adjacent said iron club head for conforming to the shape thereof.

11. The golf club headcover as defined in claim 10 wherein the golf club headcover section includes attachment means for securing a series of golf club headcovers to one another.

* * * * *

UNITED STATES PATENT AND TRADEMARK OFFICE

CERTIFICATE OF CORRECTION

PATENT NO. : 5,117,884

DATED : June 2, 1992

INVENTOR(S) : Lawrence R. Diener et al

It is certified that error appears in the above—identified patent and that said Letters Patent is hereby corrected as shown below:

Column 1, line 49, change the word "gold" to -- golf --;
Column 4, line 64, change the word "gold" to -- golf --;
Column 5, lines 36, 47 and 57, change the word "gold" to -- golf --;

now --; and
Claim 1, Column 9, line 15 is "an internal skirt", should be -- an integral skirt --.

Signed and Sealed this

Twenty-first Day of September, 1993

Bruce Lehman

*Attest:*

BRUCE LEHMAN

*Attesting Officer*

*Commissioner of Patents and Trademarks*